US010786123B1

(12) United States Patent
Chang

(10) Patent No.: US 10,786,123 B1
(45) Date of Patent: Sep. 29, 2020

(54) BATH AUXILIARY DEVICE

(71) Applicant: Tzu-Ting Chang, Yuanlin (TW)

(72) Inventor: Tzu-Ting Chang, Yuanlin (TW)

( * ) Notice: Subject to any disclaimer, the term of this patent is extended or adjusted under 35 U.S.C. 154(b) by 0 days.

(21) Appl. No.: 16/447,298

(22) Filed: Jun. 20, 2019

(30) Foreign Application Priority Data

May 30, 2019 (TW) ..... 108118779 A

(51) Int. Cl.
*A47K 7/02* (2006.01)
*A47L 13/44* (2006.01)

(52) U.S. Cl.
CPC ..... *A47K 7/028* (2013.01); *A47K 7/02* (2013.01); *A47L 13/44* (2013.01)

(58) Field of Classification Search
CPC .. A47K 7/02; A47K 7/028; A47K 7/03; A47L 13/44
See application file for complete search history.

(56) References Cited

U.S. PATENT DOCUMENTS 6,510,577 B1 * 1/2003 Borcherds ..... A47K 7/02 15/118
2002/0166189 A1 * 11/2002 Huang ..... A47K 7/028 15/209.1
2003/0041403 A1 * 3/2003 Chang ..... A47K 7/028 15/209.1
2004/0200022 A1 * 10/2004 Hsu ..... A47K 7/028 15/209.1
2014/0033459 A1 * 2/2014 Chang ..... A46B 5/0095 15/176.6
2015/0216371 A1 * 8/2015 Cassiday ..... A47K 7/03 15/104.93

* cited by examiner

*Primary Examiner* — Randall E Chin
(74) *Attorney, Agent, or Firm* — Muncy, Geissler, Olds & Lowe, P.C.

(57) ABSTRACT

A bath auxiliary device includes a front and a back communicated via a first through hole, a second through hole and a slot. The first and second through holes are separated for the slot to located therebetween. The slot has one end communicated with the first through hole and the slot has a width smaller than a diameter of the first through hole. A rope fixing portion extends outward from a periphery of the second through hole. When the bath auxiliary device is used with a bath puff, a rope of the bath puff passes through the first through hole. Then a part of the rope is positioned in the slot, and the rest of the rope is fixed to the rope fixing portion by means of winding. Thereby, the bath puff can be easily assembled to and disassembled from the bath auxiliary device, improving convenience of use.

10 Claims, 14 Drawing Sheets

BATH AUXILIARY DEVICE

BACKGROUND OF THE INVENTION

1. Field of the Invention

The present invention relates to bath tools, and more particularly to a bath auxiliary device allowing a bath puff to be assembled thereto and disassembled therefrom easily.

2. Description of the Related Art

It is common that people use bath tools such as bath puffs to improve the cleaning effects of cleaning agents like soap and body wash on skin when taking a bath. However, these common bath tools are designed to be held directly in hands and therefore usually fail to fully clean "dead spaces" on a human body (such as a human back). For addressing the problem, some handle-included bath tools have been developed to let a user hold the handle part and stretch the bath puff for extensive reach. The existing handle-included bath tools typically have the puff undetachably fixed to the handle part and need to be discarded once the puff is broken. This causes unnecessary waste.

SUMMARY OF THE INVENTION

The primary objective of the present invention is to provide a bath auxiliary device allowing a bath puff to be assembled thereto and disassembled therefrom easily.

To achieve the foregoing objective, the disclosed bath auxiliary device comprises a front and a back that are communicated via a first through hole, a second through hole and a slot. The first through hole and the second through hole are separated so that the slot is located between the first through hole and the second through hole. The slot has one end communicated with the first through hole. The slot has a width smaller than a diameter of the first through hole. A rope fixing portion extends from a periphery of the second through hole away from the second through hole.

With the foregoing configuration, when the disclosed bath auxiliary device and a bath puff assembled, the net of the bath puff is received by the front receive and the rope of bath puff passes through the first through hole to be positioned in the slot before fixed to the rope fixing portion by means of tying or winding, so the bath puff can be easily assembled and disassembled, improving convenient of use.

Preferably, the first through hole and the second through hole may be located along an imaginary line or not, according to practical needs.

Preferably, the first through hole and the slot are each made two, and the second through holes are located between the two first through hole so that the bath auxiliary device can be used with two bath puffs.

Preferably, the first through hole, the second through hole and the rope fixing portion are each made two, and the two separated second through holes are located between the two first through holes, so that the bath auxiliary device can be used with two bath puffs.

Preferably, the rope fixing portion may jut out of the front or the back according to practical needs so that the rope of the bath puff may pass through the second through hole or not depending on the location of the rope fixing portion.

The present invention will be described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

DETAILED DESCRIPTION OF THE INVENTION

Figure 1:
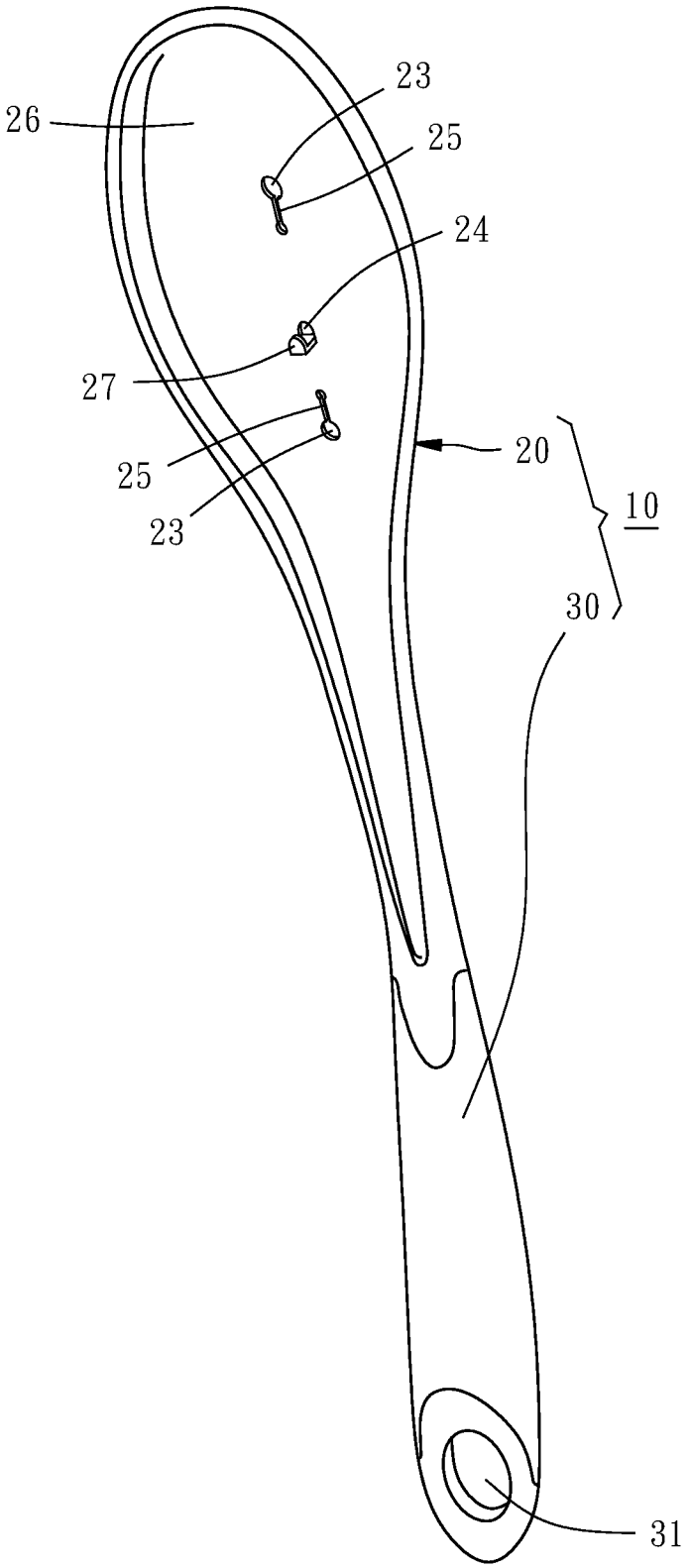
FIG. 1 is a perspective view of a bath auxiliary device according to a first embodiment of the present invention.

The following preferred embodiments when read with the accompanying drawings are made to clearly exhibit the above-mentioned and other technical contents, features and effects of the present invention. It is to be noted first that throughout this document, including embodiments described herein and the appended claims, all the directional terms shall be interpreted based on the directions as the relevant components shown in the drawings. Unless otherwise noted, like elements will be identified by identical numbers throughout all figures.

Figure 2:
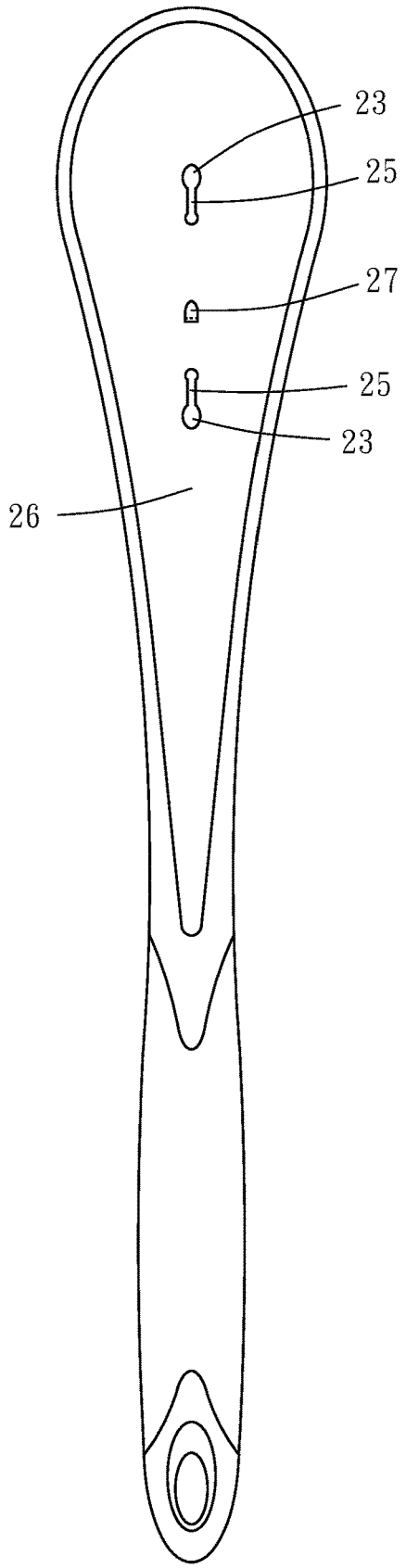
FIG. 2 is a front view of the bath auxiliary device according to the first embodiment of the present invention.
Figure 3:
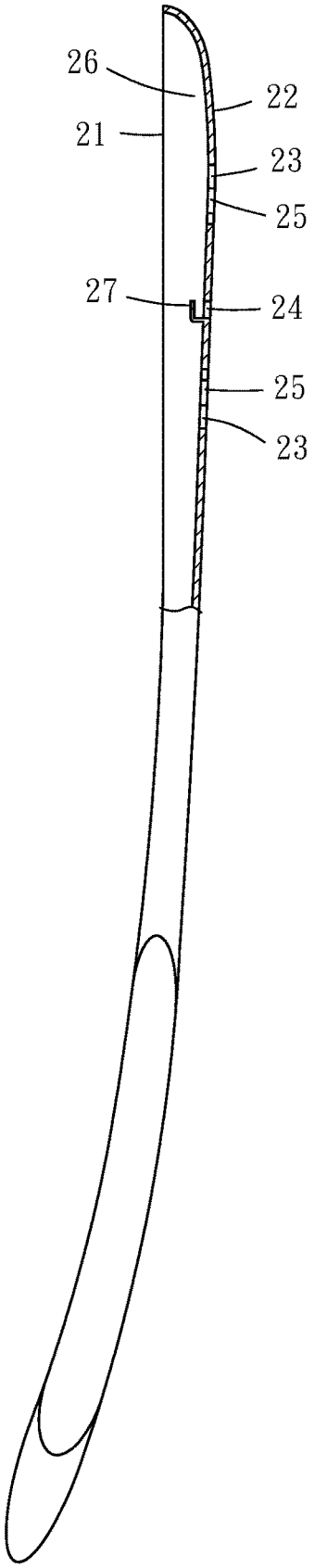
FIG. 3 is a vertically cross-sectional view of the bath auxiliary device according to the first embodiment of the present invention.
Figure 4:
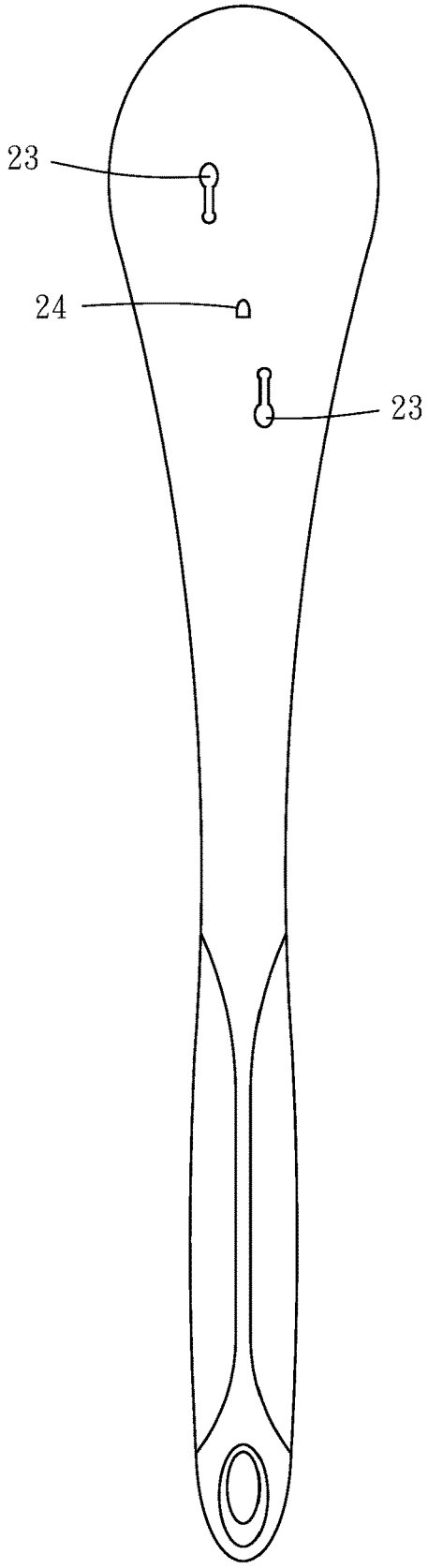
FIG. 4, like FIG. 2, shows the configuration where the first through holes and the second through hole are not located along an imaginary line.

Referring to FIG. 1, according to the first embodiment of the present invention, a bath auxiliary device 10 comprises a support board 20 and a handle 30. The support board 20 and the handle 30 are formed integratedly. The handle 30 has one end thereof connected to the support board 20, and has the other end provided with a hanging hole 31. However, the handle 30 may be omitted in other embodiments. Also referring to FIG. 2 and FIG. 3, the support board 20 has a front 21 and a back 22. The front 21 and back 22 are communicated with each other via two round first through holes 23, a round second through hole 24, and two vertically extending slots 25. Therein, the two first through holes 23 are separated from each other, and the second through hole 24 is located between the two first through holes 23. The slot 25 has a width smaller than a diameter of the first through hole 23. The slot 25 has one end thereof communicated with the first through hole 23 and extends linearly toward the second through hole 24. The two first through holes 23 and the second through hole 24 may be configured along an imaginary line, as shown in FIG. 2. Alternatively, they can be configured non-linearly, as shown in FIG. 4. In addition, as shown in FIG. 2, the front 21 of the support board 20 is formed with a reversed teardrop shaped basin 26. Further, as shown in FIG. 3, the support board 20 has a hook-like rope fixing portion 27. The rope fixing portion 27 extends from the bottom of the second through hole 24 away from the second through hole 24 and juts out of the front 21 of the support board 20.

Figure 5:
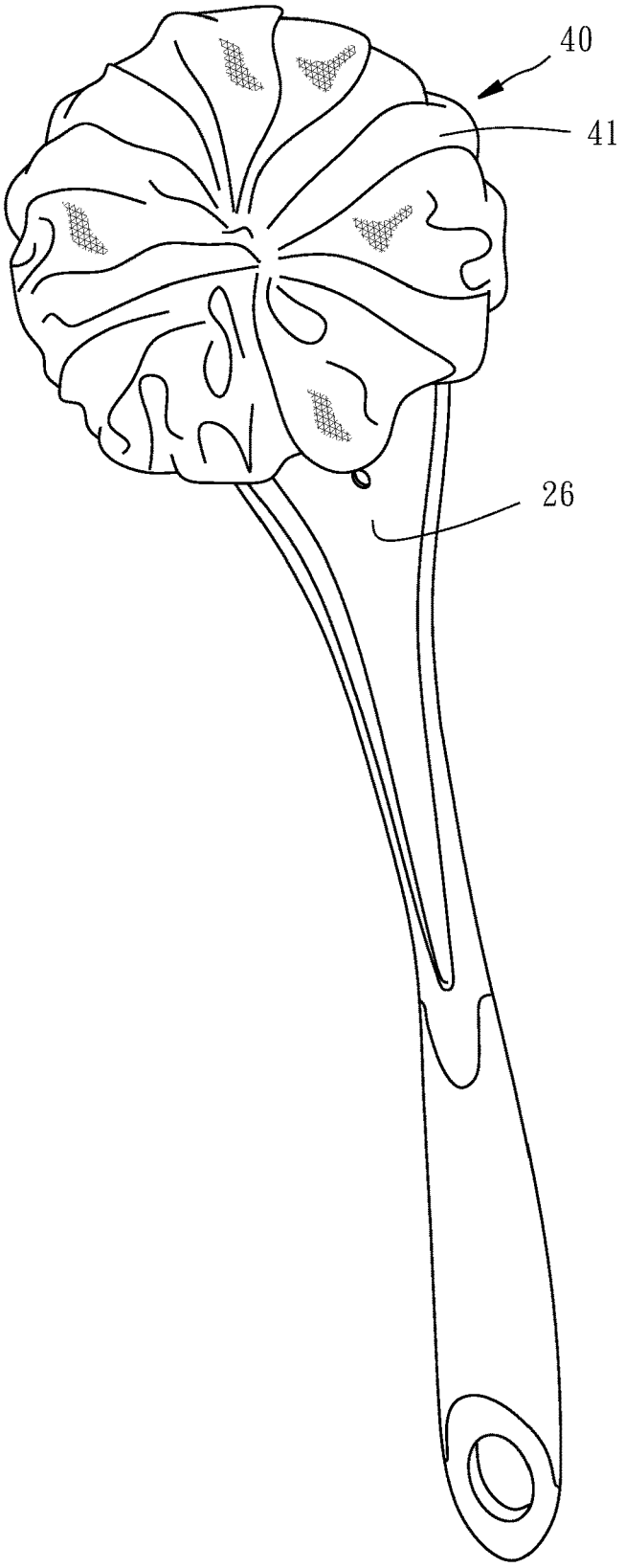
FIG. 5 is an applied perspective view of the bath auxiliary device according to the first embodiment of the present invention, showing a bath puff is assembled thereto.
Figure 6:
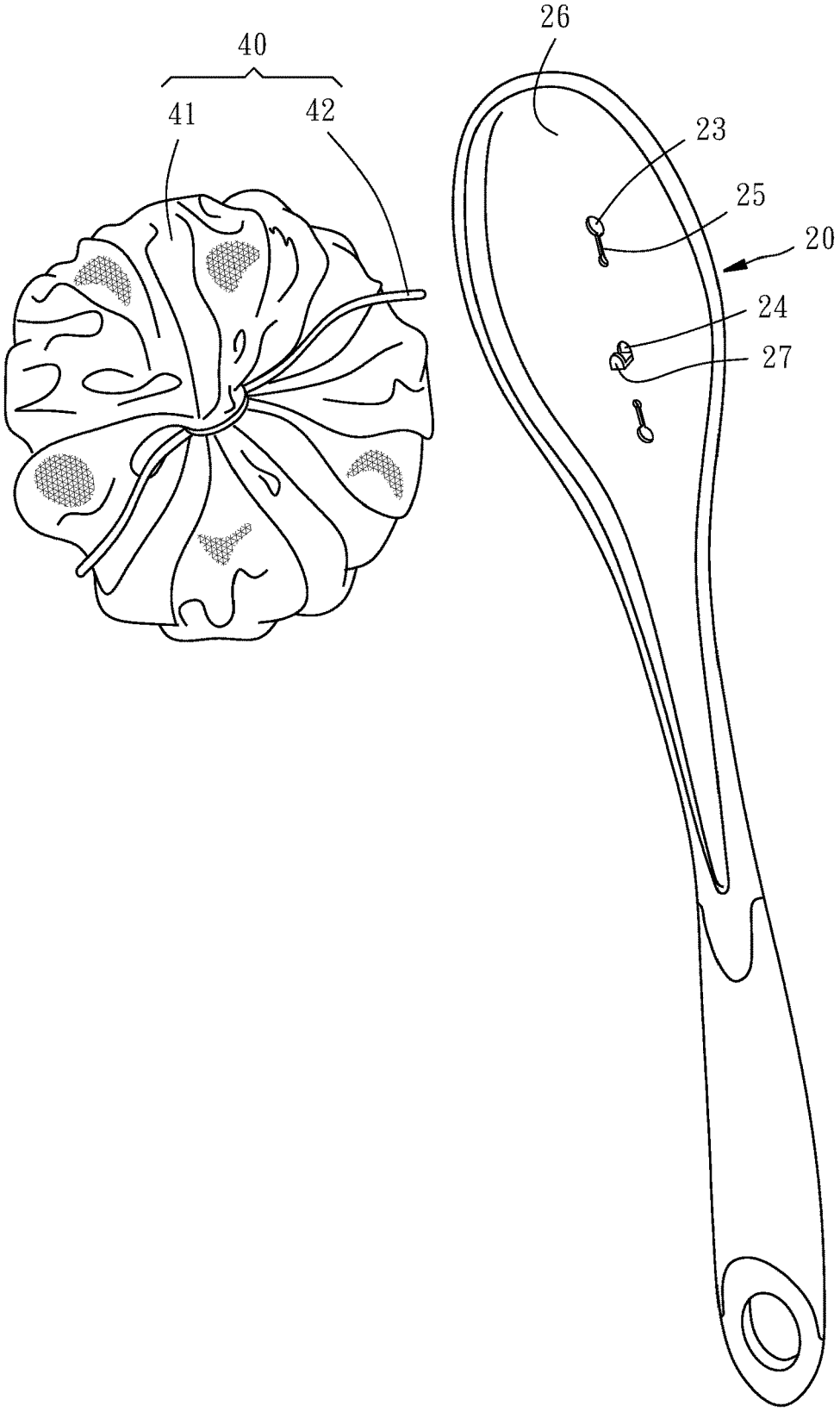
FIG. 6 is an applied exploded view of the bath auxiliary device according to the first embodiment of the present invention, showing a bath puff is assembled thereto.
Figure 7:
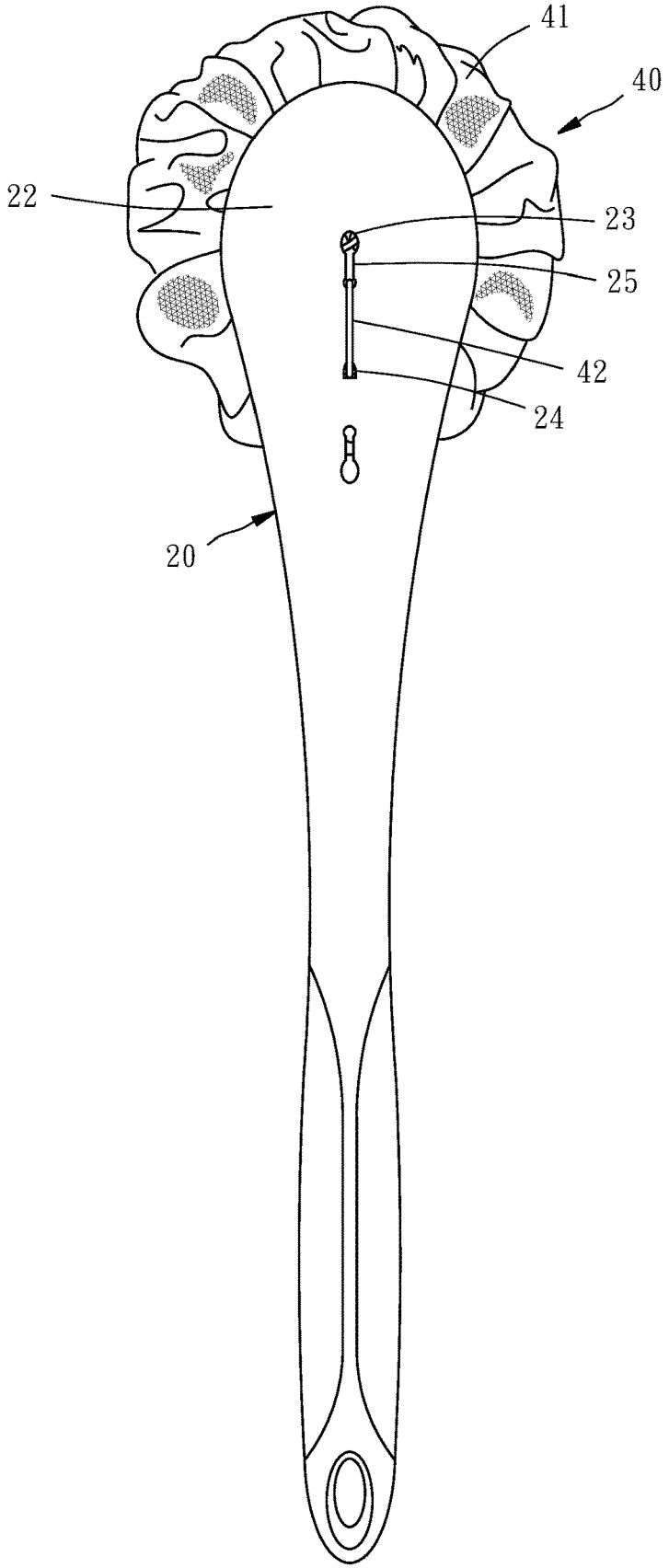
FIG. 7 is an applied back view of the bath auxiliary device according to the first embodiment of the present invention, showing a bath puff is assembled thereto.

The bath auxiliary device 10 is designed to be used with a bath puff 40. As shown in FIG. 5 through FIG. 7, the bath puff 40 may have a crumpled net 41 and a rope 42 connected to the net 41. In use, the rope 42 of the bath puff 40 first passes through the first through hole 23 from the front 21 of the support board 20. A part of the rope 42 is fit and positioned in the slot 25 and then the rest of the rope 42 passes through the second through hole 24 from the back 22 of the support board 20 and is fixed to the rope fixing portion 27 by means of tying or winding. At this time, the net 41 of the bath puff 40 is rest in the basin 26 of the support board 20, and the bath puff 40 is well assembled to the bath auxiliary device 10. When the net 41 is broken after long use, the puff 40 can be easily removed and replaced with a one by releasing the rope 42 from the rope fixing portion 27.

Figure 8:
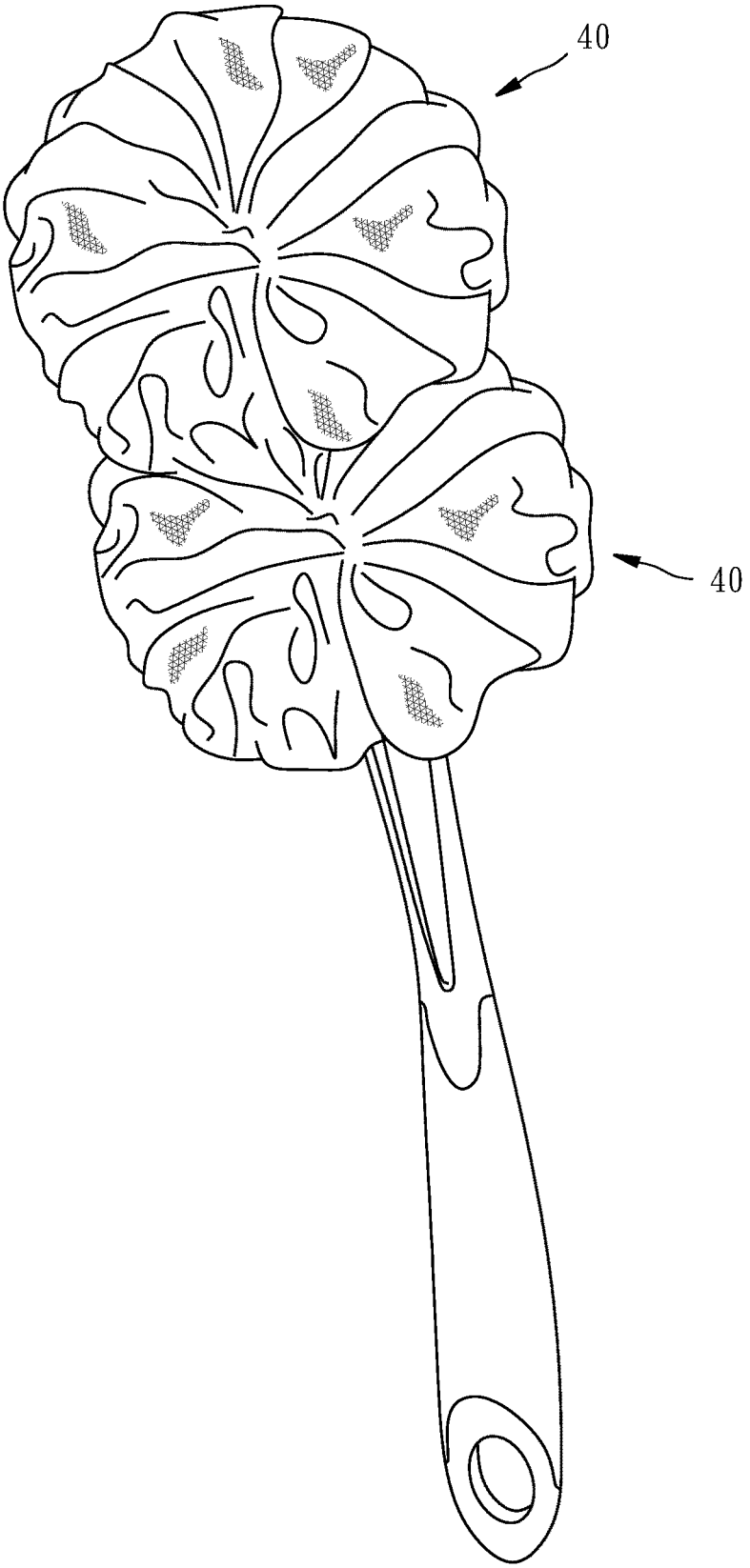
FIG. 8 is an applied perspective of the bath auxiliary device according to the first embodiment of the present invention, showing two bath puffs are assembled thereto.
Figure 9:
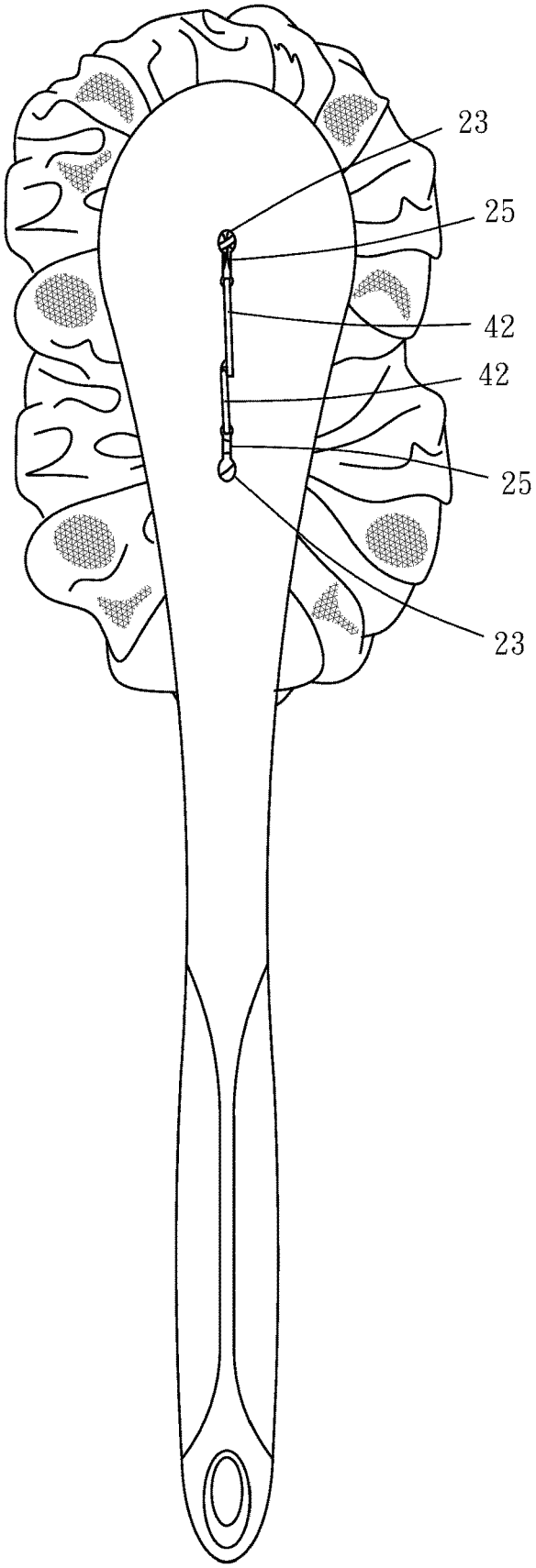
FIG. 9 is an applied back view of the bath auxiliary device according to the first embodiment of the present invention, showing two bath puffs are assembled thereto.

Additionally, in the first embodiment of the present invention, since the support board 20 has the two first through holes 23 and the two slots 25, it is compatible to use of two said bath puffs 40 that are assembled, respectively, in the manner described above. As shown in FIG. 8 and FIG. 9, the two bath puffs 40 may have their ropes 42 fixed to the rope fixing portion 27 by means of tying or winding. Alternatively, one of the bath puffs 40 has its rope 42 tied to or wounded around the rope fixing portion 27, while the other bath puff 40 has its rope 42 positioned in the slot 25.

Figure 10:
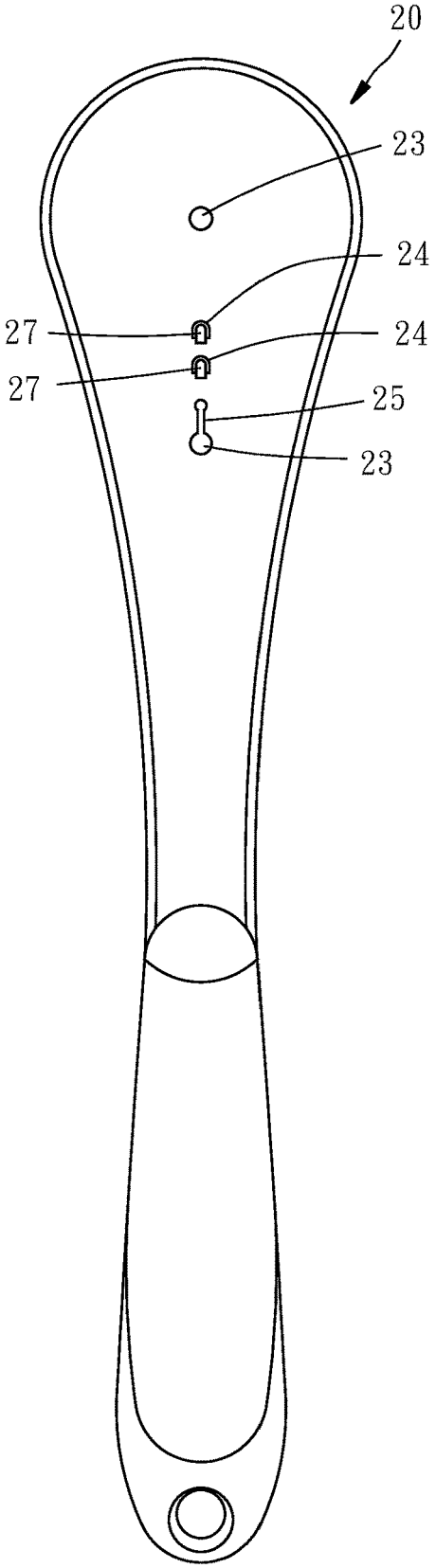
FIG. 10 is a back view of a bath auxiliary device according to the second embodiment of the present invention.
Figure 11:
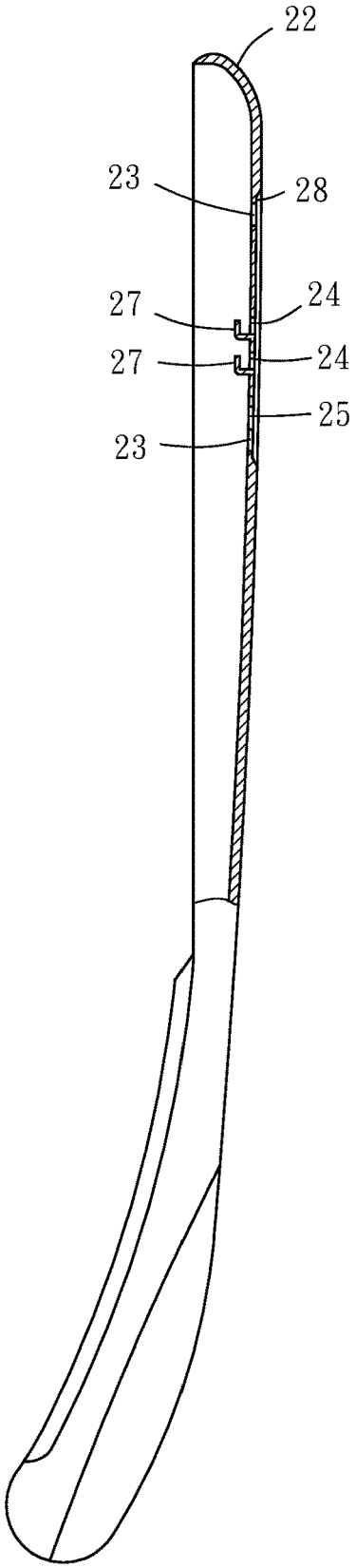
FIG. 11 is a vertically cross-sectional view of the bath auxiliary device according to the second embodiment of the present invention.
Figure 12:
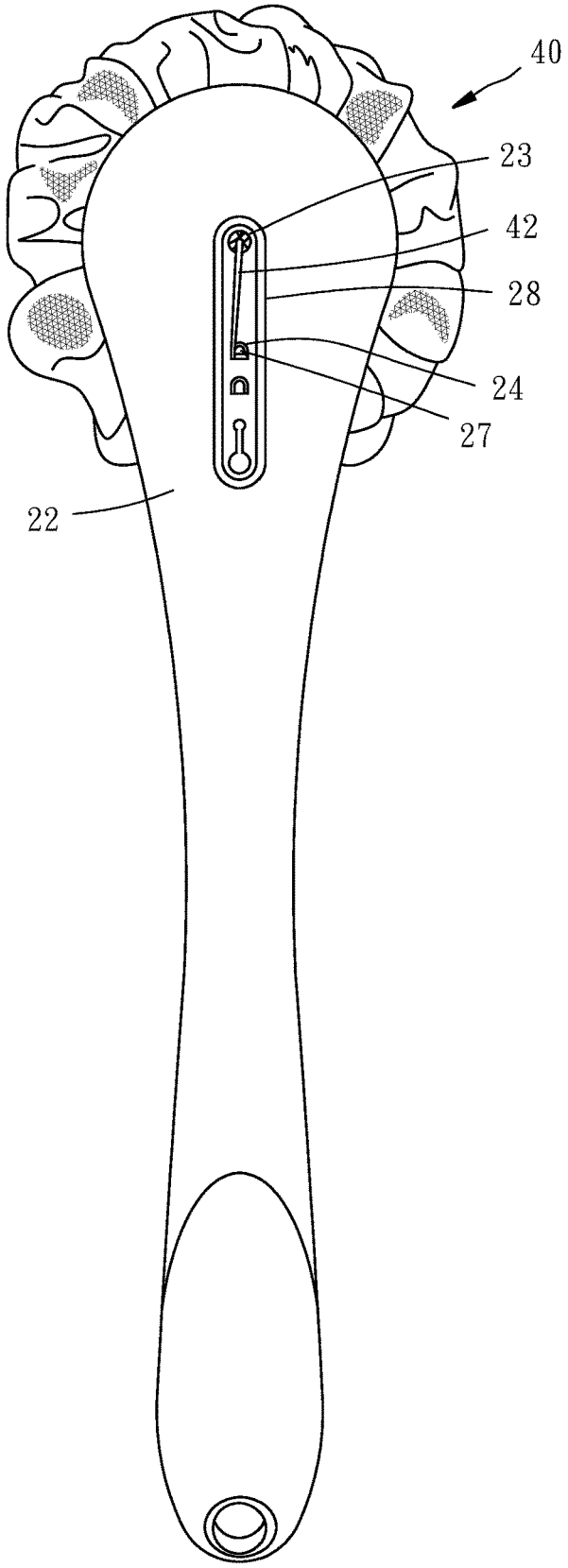
FIG. 12 is an applied back view of the bath auxiliary device according to the second embodiment of the present invention, showing a bath puff is assembled thereto.

The present invention may be embodied in different structures. Referring to FIG. 10 and FIG. 11, in the second embodiment of the present invention second embodiment, two sets of a second through hole 24 and a rope fixing portions 27 are separated from each other, and only one slot 25 is arranged below the two second through holes 24. Alternatively, as shown in FIG. 12, the back 22 of the support board 20 is further provided with an elliptic groove 28. The elliptic groove 28 encircles two first through holes 23, two second through holes 24 and a slot 25. The two first through holes 23 are located near upper and lower ends of the elliptic groove 28, and the two second through holes 24 are located in the middle part of the area encircled by the elliptic groove 28.

Figure 13:
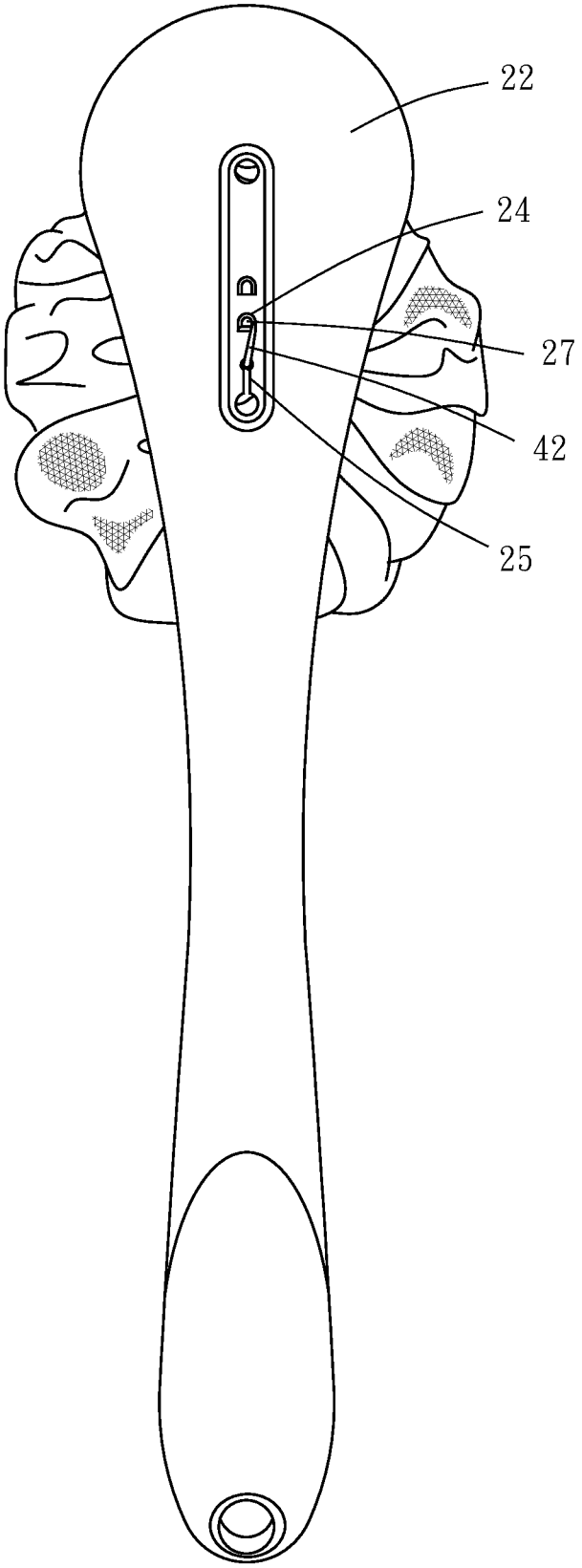
FIG. 13 is another applied back view of the bath auxiliary device according to the second embodiment of the present invention, showing a bath puff is assembled thereto.

When the bath auxiliary device 10 is used with a bath puff 40, as shown in FIG. 12, the rope 42 of the bath puff 40 may pass through the first through hole 23 from the front 21 of the support board 20, and pass through one of the second through holes 24 from the back 22 of the support board 20 before fixed to the rope fixing portion 27 by means of tying or winding. Alternatively, the rope 42 of the bath puff 40 passes through the first through hole 23 from the front 21 of the support board 20. As shown in FIG. 13, a part of the rope 42 is fit and positioned in the slot 25, and the rest of the rope 42 passes through one of the second through holes 24 from the back 22 of the support board 20 and is fixed to the rope fixing portion 27 by means of tying or winding.

Figure 14:
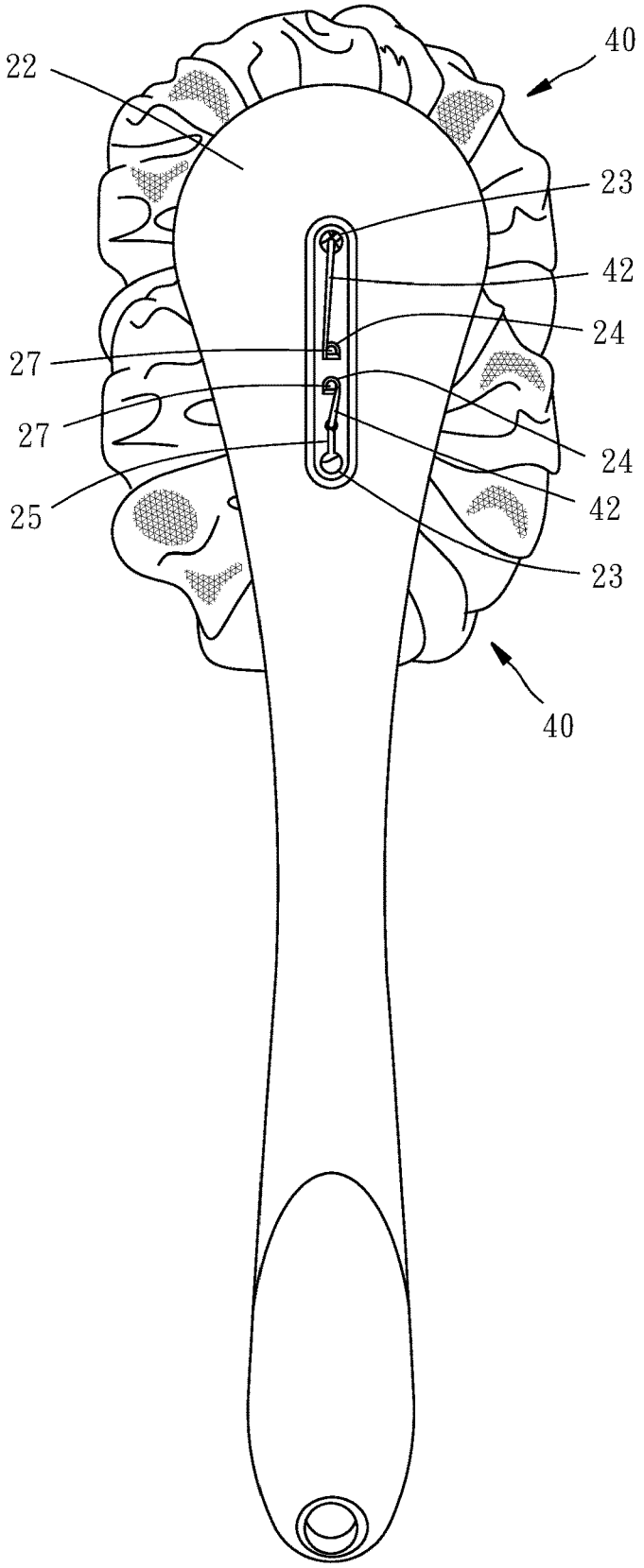
FIG. 14 is an applied back view of the bath auxiliary device according to the second embodiment of the present invention, showing two bath puffs are assembled thereto.

When the bath auxiliary device 10 is used with two bath puff 40, as shown in FIG. 14, the ropes 42 of the two bath puff 40 pass through the two first through holes 23 from the front 21 of the support board 20 and the rope 42 of one of the bath puffs 40 passes through the second through hole 24 from the back 22 of the support board 20 and is fixed to the rope fixing portion 27 by means of tying or winding. The rope 42 of the other bath puff 40 has one part thereof fit and positioned in the slot 25 and the rest of it passes through the second through hole 24 from the back 22 of the support board 20 and is fixed to rope fixing portion 27 by means of tying or winding.

Figure 15:
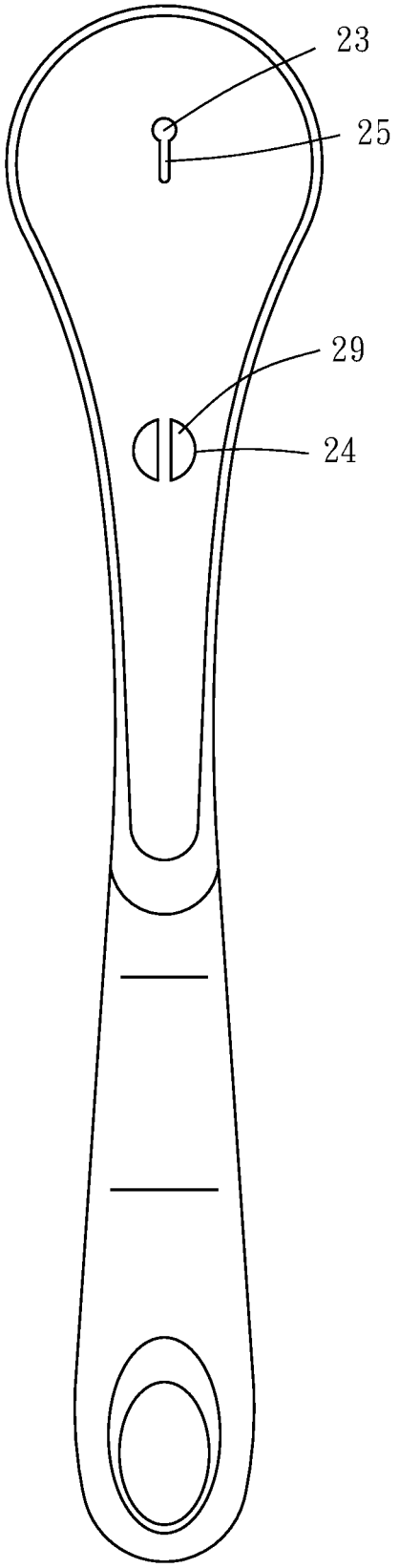
FIG. 15 is a back view of a bath auxiliary device according to the third embodiment of the present invention.
Figure 16:
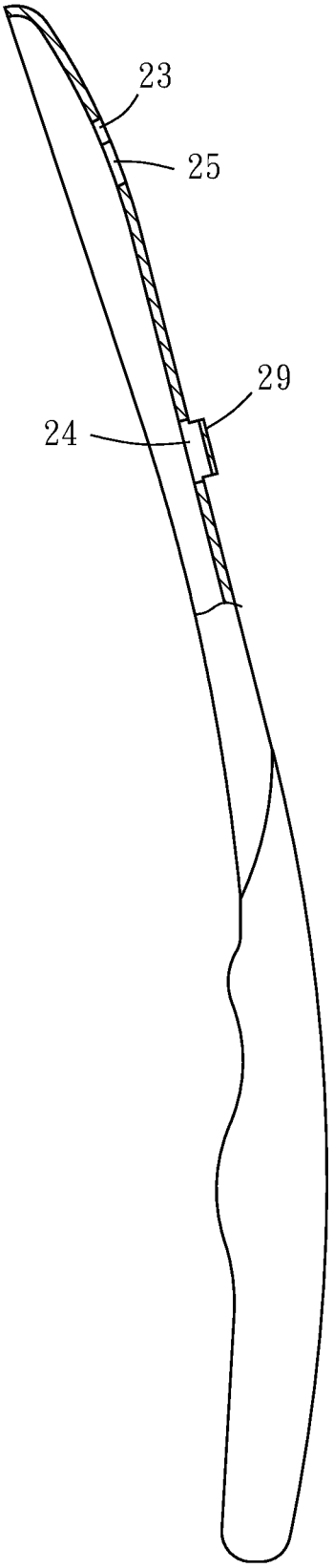
FIG. 16 is a vertically cross-sectional view of the bath auxiliary device according to the third embodiment of the present invention.
Figure 17:
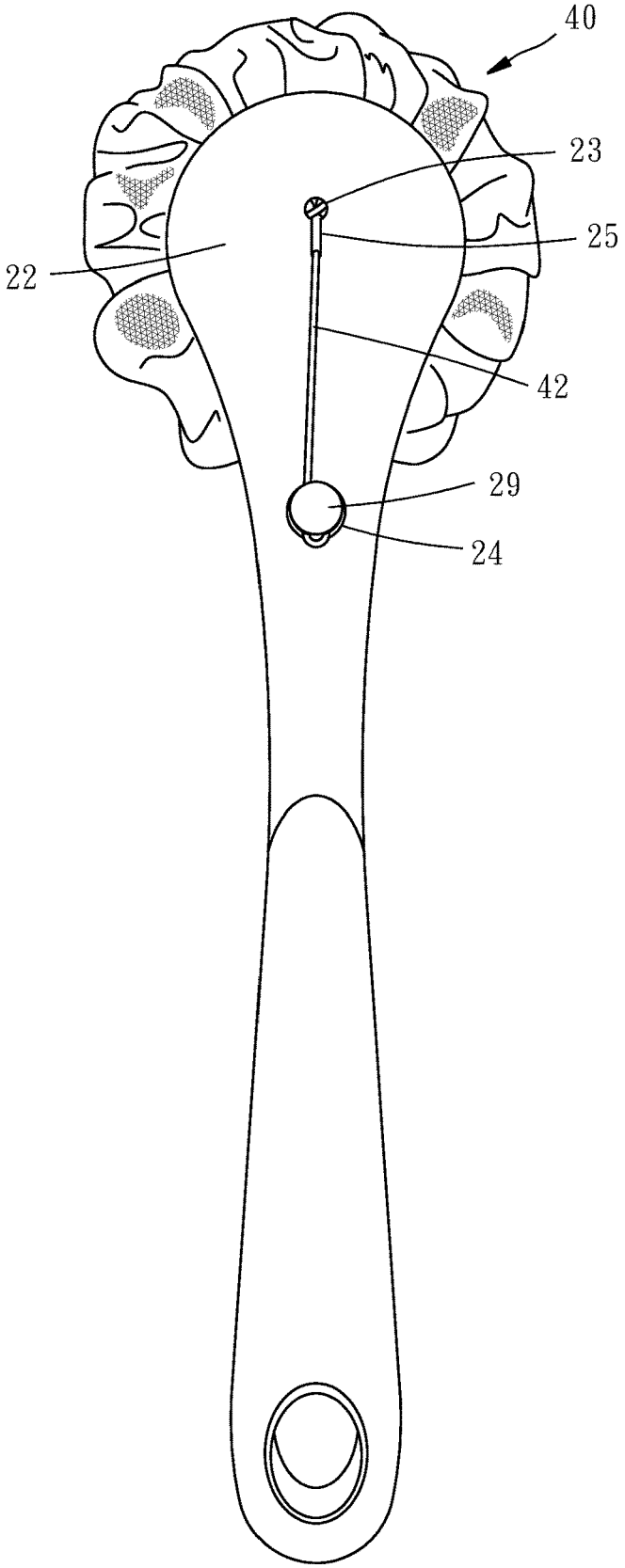
FIG. 17 is an applied back view of the bath auxiliary device according to the third embodiment of the present invention, showing a bath puff is assembled thereto.

Referring to FIG. 15 and FIG. 16, in the third embodiment of the present invention, one first through hole 23 and one slot 25 are located above the second through hole 24. A rope fixing portion 29 juts out of the back 22 of the support board 20 and is formed like a rivet. When the bath auxiliary device 10 is used with a bath puff 40, as shown in FIG. 17, the rope 42 of the bath puff 40 passes through the first through hole 23 from the front 21 of the support board 20, and a part of the rope 42 is fit and positioned in the slot 25. Then the rest of the rope 42 is directly fixed to the rope fixing portion 29 by means of tying or winding, without passing through the second through hole 24.

To sum up, the disclosed bath auxiliary device 10 allows one or two bath puffs 40 to install conveniently and quickly. Once the bath puff 40 is broken, the old bath puff 40 can be easily removed and replaced by a new one. Therefore, the bath auxiliary device 10 of the present invention can be repeatedly used, thereby improving usability and reducing waste.

What is claimed is:

1. A bath auxiliary device to be used with:

a bath puff, the bath puff having a net and a rope connected to the net, the bath auxiliary device comprising a front for supporting the net and a back, the front and the back being communicated with each other via a first through hole that allows the rope to pass therethrough, a second through hole that allows the rope to pass therethrough, and a slot that positions the rope, the first through hole and the second through hole being separated from each other, the slot being located between the first through hole and the second through hole, the slot having one end thereof communicated with the first through hole, the slot having a width smaller than a diameter of the first through hole, and the bath auxiliary device further having a rope fixing portion for fixing the rope, which extends from a periphery of the second through hole away from the second through hole.

2. The bath auxiliary device of claim 1, wherein the first through hole and the second through hole are located along an imaginary line.

3. The bath auxiliary device of claim 1, wherein the first through hole and the second through hole are not located along an imaginary line.

4. The bath auxiliary device of claim 1, comprising two said first through holes and two said slots, wherein the second through hole is located between the two first through holes.

5. The bath auxiliary device of claim 1, comprising two said first through holes, two said second through holes, and two said rope fixing portions, wherein the two second through holes are arranged successively and separately while located between the two first through holes.

6. The bath auxiliary device of claim 5, wherein the back is provided with an elliptic groove, so that two first through holes are located near two ends of the elliptic groove and the two second through holes are located in a middle part of an area circled by the elliptic groove.

7. The bath auxiliary device of claim 1, wherein the front is formed with a reversed teardrop shaped basin.

8. The bath auxiliary device of claim 1, wherein the rope fixing portion juts out of the front.

9. The bath auxiliary device of claim 1, wherein the rope fixing portion juts out of the back.

10. The bath auxiliary device of claim 1, further comprising a support board and a handle, wherein the support board has the front and the back, and the handle has one end thereof connected to the support board and an opposite end thereof provided with a hanging hole.

* * * * *